US005167795A

United States Patent [19]

Gartside

[11] Patent Number: 5,167,795

[45] Date of Patent: Dec. 1, 1992

[54] PROCESS FOR THE PRODUCTION OF OLEFINS AND AROMATICS

[75] Inventor: Robert J. Gartside, Wellesley, Mass.

[73] Assignee: Stone & Webster Engineering Corp., Boston, Mass.

[21] Appl. No.: 758,531

[22] Filed: Sep. 6, 1991

Related U.S. Application Data

[63] Continuation of Ser. No. 449,130, Dec. 8, 1989, abandoned, which is a continuation of Ser. No. 149,643, Jan. 28, 1988, abandoned.

[51] Int. Cl.[5] ..... C10G 11/18; C07C 4/06

[52] U.S. Cl. ..... 208/67; 208/480; 208/113; 208/160; 585/322; 585/324; 585/427; 585/417; 585/418; 585/650; 585/651; 585/653; 585/654; 585/910; 585/911

[58] Field of Search ..... 208/489, 49, 67, 69, 208/70, 74, 113, 153, 159, 160; 585/322, 330, 324, 407, 651, 654, 653, 650, 910, 911, 417, 418

[56] References Cited

U.S. PATENT DOCUMENTS

| | | | |
|---|---|---|---|
| 2,776,727 | 1/1957 | Boisture | 208/161 |
| 2,906,695 | 9/1959 | Boston | 208/127 |
| 3,074,878 | 1/1963 | Pappas | 208/161 |
| 4,288,235 | 9/1981 | Gartside et al. | 55/196 |
| 4,370,303 | 1/1983 | Woebcke et al. | 208/127 |
| 4,374,019 | 2/1983 | Hettinger et al. | 208/120 |
| 4,405,445 | 9/1983 | Kovach et al. | 208/158 |
| 4,419,221 | 12/1983 | Castagnos Jr. et al. | 208/113 |
| 4,427,537 | 1/1984 | Dean et al. | 208/157 |
| 4,427,539 | 1/1984 | Busch et al. | 208/127 |
| 4,433,984 | 2/1984 | Gartside et al. | 55/196 |
| 4,471,151 | 9/1984 | Kolts | 585/651 |
| 4,552,644 | 11/1985 | Johnson et al. | 208/78 |
| 4,585,544 | 4/1986 | Gartside et al. | 208/91 |
| 4,624,771 | 11/1986 | Lane et al. | 208/113 |
| 4,675,461 | 6/1987 | Owen et al. | 585/330 |
| 4,764,268 | 8/1988 | Lane | 208/113 |
| 4,859,308 | 8/1989 | Harandi et al. | 258/49 |

FOREIGN PATENT DOCUMENTS 2048299 12/1980 United Kingdom .

OTHER PUBLICATIONS

Chen et al., "Non-regenerative Cat. Cracking of Gas Oils", Indus. and Engineering Develop., vol. 25, No. 3, 1986.

*Primary Examiner*—Anthony McFarlane
*Attorney, Agent, or Firm*—Hedman, Gibson & Costigan

[57] ABSTRACT

A process for the production of olefins and aromatics from hydrocarbon feedstocks by catalytically cracking alone or cracking and dehydrogenating the hydrocarbons in the presence of an entrained stream of catalytic heat carrying solids at short residence times to preferentially produce olefins having three or more carbon atoms and/or to produce aromatics, especially benzene.

14 Claims, 7 Drawing Sheets

PROCESS FOR THE PRODUCTION OF OLEFINS AND AROMATICS

CROSS REFERENCE TO RELATED APPLICATIONS

The present application is a continuation of Ser. No. 07/449,130, filed Dec. 8,1989, now abandoned, which in turn is a continuation of Ser. No. 07/149,643, filed Jan. 28, 1988, now abandoned.

FIELD OF THE INVENTION

This invention relates to the production of olefins and aromatics from hydrocarbon feedstocks. More particularly, the invention relates to the production of olefins and aromatics by catalytically cracking alone or cracking and dehydrogenating a hydrocarbon. Most particularly the invention relates to a process for cracking hydrocarbons in the presence of an entrained stream of catalytic heat carrying solids at short residence times to preferentially produce olefins having three or more carbon atoms and/or to produce aromatics, specifically benzene.

BACKGROUND OF THE INVENTION

It has long been known that naturally occurring hydrocarbons can be cracked at high temperatures to produce valuable olefinic materials, such as ethylene and propylene.

The growth in the propylene based plastics market relative to the ethylene based plastics market has made it desirable to improve the propylene yield when cracking hydrocarbons to olefins.

In addition, higher order olefins, e.g., $C_4$ olefins, are important precursors for providing high octane blending components, i.e., $C_4$'s are precursors to MTBE production and alkylation.

However, when heavy hydrocarbons feedstocks are non-catalytically cracked to olefins it's virtually impossible to achieve the desired co-product ratios to fit market needs, i.e., propylene to ethylene yield ratios are rarely greater than 0.55. Higher ratios are attainable only at low hydrocarbon conversion which represents a significant processing penalty in terms of recycle costs and feed degradation. One well-known non-catalytic cracking process is pyrolysis which typically takes place in the presence of steam at high temperatures. The mechanism by which pyrolysis to olefins is achieved is explained in terms of a free radical mechanism.

At high temperatures, radical initiation takes place by homolysis of a carbon - carbon bond. Once initiated, the free radicals undergo two principal reactions. They are (1) scission at the beta position of the radical and (2) abstraction of a hydrogen, resulting in termination of the reaction.

The scission at the beta position will continue to the point where a methyl radical will be formed at 90 percent frequency. The methyl radical will then abstract a hydrogen atom from another molecule to form methane and another free radical. Ethylene and methane are the principal products from such free radical pyrolysis reactions. Only about 10 percent of the time will a longer radical abstract a hydrogen from a molecule to form $C_3$ to $C_7$ paraffins and olefins. Thus, thermal cracking results in high yields of ethylene relative to higher order olefins with the higher order olefins occurring principally as a result of hydrocarbon branching in the initial hydrocarbon feedstock.

One effort at producing increased production of $C_3$ and higher olefins is directed to subjecting a light hydrocarbon comprising at least one alkane to cracking conditions in the presence of hydrogen sulfide and a solid contact material comprising silica (Kolts, U.S. Pat. No. 4,471,151). The contact material employed, such as silica gel, preferably has a high surface area i.e. at least 50 m $^2$/gm. Typical $H_2S$ concentrations of 0.1 to 10 mole percent based on the alkane feed are employed in the process. It is theorized in Kolts that the improvement in cracking is due to the high surface area material which acts as a catalyst to decompose $H_2S$. The result is increased conversion levels with improved selectivity to desired products. However, the improved selectivity to propylene was demonstrated only when cracking n-butane.

The solid contact material employed in Kolts is suitable only for fixed bed operations and not for fluidized bed environments due to its very low mechanical stability. Thus, the solid catalyst of Kolts continues to have the drawbacks of typical catalytic dehydrogenation catalysts designed for fixed beds. These are larger size, diffusion limited catalysts incapable of continuous regeneration in a circulating loop system.

A fluidized catalytic cracking (FCC) unit may also be employed to catalytically produce $C_3$ and higher compounds. The FCC unit uses acidic cracking catalysts to increase the production of $C_3$ to $C_7$ compounds through a carbonium ion mechanism compared to the free radical pyrolysis reaction mechanism. However, the acidic cracking activity of the catalysts, in addition to promoting cracking and isomerization, promotes rapid hydrogen transfer resulting in high yields of paraffins rather than olefins. Further, the nature of the catalytic cracking unit itself favors the shift to paraffins.

The typical definition of residence time in a catalytic cracking operation is the time the feedstock is in contact with the catalyst itself. This definition is acceptable if the temperatures are low such that thermal reactions do not occur to any appreciable extent. However, thermal and catalytic reactions proceed in parallel. While catalyst separation will terminate the catalytic portion of the reaction the thermal reactions (pyrolysis) will continue until the temperature is reduced to a level where the rate of reaction is insignificant (quench). In this situation, the total kinetic residence time can be defined as the time from the introduction of the hydrocarbon into the system to the quenching of the effluent including the separation of the solids from the reaction. Total conversion is thus the summation of the catalytic reaction (time in contact with the catalyst) and the thermal reactions (time at the reaction temperature).

The typical FCC reaction environment has relatively long residence times including time for solids separation (normally greater than one second) and does not include a quench. Cracking takes place at lower temperatures under these longer residence times. Conversion is achieved at these lower temperatures due to the extended contact with the catalyst Thermal reactions are minimized at these lower temperatures thus eliminating the need for quenching the effluent. While increased $C_3$ and higher compounds are produced in comparison to pyrolysis, the effluent will have a disproportionately high concentration of paraffins due to the increased hydrogen transfer activity. The favored conditions for olefin production, specifically higher temperatures and shorter residence times, are difficult to achieve especially when processing light feedstocks such as LPG and naphthas which require proportionately higher temperatures to initiate and sustain the reaction (either catalytic or thermal).

The above processes all improve the cracking of hydrocarbons to olefins. However, these processes suffer either from high capital and operating costs associated with fixed bed operations and hydrogen sulfide dilution, or result in low yields of the desired olefins. In addition, the use of hydrogen sulfide as a diluent raises environmental and health concerns because of its extremely high toxicity.

It has now been found that the higher order olefins, i.e. propylene, butenes, etc. can be obtained in high yields by the cracking of hydrocarbons in the presence of an acidic cracking catalyst alone or in combination with a noble metal oxide dehydrogenation catalyst in a short residence time fluidized solids cracking environment. This short residence time is achieved by a combination of a low residence time reactor, a very short residence time separation system, and a product quench.

It is therefore an object of the present invention to provide a process in which hydrocarbons can be catalytically cracked to produce olefins and aromatics.

It is another object of the present invention to provide a process for preferentially cracking hydrocarbons to obtain $C_3$ to $C_5$ olefins and/or aromatics.

It is another object of the present invention to provide a process in which a hydrocarbon may be cracked to a variety of desired products by altering the catalyst system in the process.

It is a further object of the present invention to provide a reaction system including a quenching step for preferentially cracking hydrocarbons to obtain $C_3$ to $C_5$ olefins and/or aromatics while avoiding the thermal degradation of products.

SUMMARY OF THE INVENTION

The present invention relates generally to a process for preferentally cracking hydrocarbons to obtain olefins, preferably $C_3$ to $C_5$ olefins, and aromatics at the acid sites of catalyst solids and, optionally, catalytically dehydrogenating the resulting paraffin isomers to thereby produce olefins.

Acidic catalytic cracking of hydrocarbons proceeds by a carbonium ion mechanism unlike the free radical mechanism of thermal cracking. The carbonium ion is formed by the abstraction of a hydride ion from the carbon-hydrogen bond. The abstraction of the hydride ion and the creation of a carbonium ion is catalyzed by the acid sites on the catalyst solids.

Carbonium ion cracking also occurs at the beta position thereby leading to the formation of an olefin and a primary carbonium ion. The primary carbonium ion undergoes a rapid ionic shift (isomerization) to produce a secondary or tertiary carbonium ion. This coupled with the beta cracking rule leads to the formation of propylene in high yields without the concurrent production of significant amounts of ethylene. Any ethylene found in the product is the result of the competitive free radical cracking route. In addition to providing the carbonium ion mechanism for isomerization, the acidic sites on the catalyst promote hydrogen transfer. Thus, while the thermodynamic equilibrium conditions at the temperatures contemplated in the invention favor olefins over paraffins, the increased hydrogen transfer activity may result in a disproportionately high paraffin yield. This is especially true for the branched isomers such as isobutylene. In these cases, if a specific dehydrogenation catalyst is used in combination with an acidic cracking catalyst, the yield distribution can be shifted toward the thermodynamic equilibrium and higher concentrations of the desired olefins can be obtained.

For the purpose of this invention, the kinetic residence time is defined as the total time from the point where the hydrocarbon is introduced to the reactor zone to the point where the cracked products are quenched, including the intermediate separation step. This distinguishes the present process from other processes where measurement of the residence time is terminated prior to the point of separation and quench. This is especially important since the catalytic cracking of hydrocarbons always proceeds in parallel with pyrolysis. The extent to which products are formed catalytically or thermally is a function of catalyst activity, catalyst loading, catalyst residence time, reaction temperature profile, and the total kinetic residence time in the thermal-catalytic environment. For example, mild acidic catalytic activity at higher temperatures could be used to shift diolefin production to paraffins and olefins without substantially altering the ratio of the carbon products obtained by pyrolysis. Alternatively, very highly active acidic cracking catalysts could be used at significantly lower temperatures to minimize the thermal route and maximize the acidic catalyst product distribution. Further, it has been found that catalytic dehydrogenation catalysts can be used in combination with the acidic cracking catalysts to shift the reaction in favor of olefin production.

The present invention is particularly well suited for cracking hydrocarbon feedstocks such as $C_4$–$C_7$ paraffins, naphthas, and light gas oils to higher order olefins, i.e., having three to five carbon atoms and/or to aromatics. However, it should be noted that the process has general applications for cracking the entire range of hydrocarbons from light distillates to heavy resids.

The process of the present invention proceeds by delivering a preheated hydrocarbon feedstock and steam to the top of a downflow tubular reactor. Simultaneously, hot catalyst solids are introduced to the top of the reactor and the combined stream of hydrocarbon, steam and catalyst solids pass through the reactor zone, a separation zone, and a quench zone where the hydrocarbon undergoes cracking at low severity and short residence times and the effluent is stabilized to prevent product degradation.

The tubular reactor is operated at a temperature of about 900°–1500° F., preferably 1000°–1300° F. and at a pressure of about 10–100 psia with a total kinetic residence time of about 0.05 to 2.0 seconds, preferably about 0.10 to 0.5 seconds.

After separation from the cracked effluent the catalyst solids are stripped of residual hydrocarbon, regenerated and reheated in a transfer line and returned to the tubular reactor to continue the cracking process.

The present invention is particularly well adapted foruse in a short residence time fluidized solids cracking apparatus and in a short residence time separation apparatus, as described in U.S. Pat. Nos. 4,370,303 to Woebcke et al, and 4,433,984 to Gartside et al, and pending U.S. Ser. No. 084,328 to Gartside et al each of which is incorporated herein by reference.

The specific catalyst solids and the catalyst to hydrocarbon ratio are chosen based on the feedstock characteristics and the product distribution desired. Catalyst activity and catalyst loading will define operating temperatures at the short residence times employed in the present invention and thus determine the split between the catalytic and thermal reactions. The catalyst type, either acidic cracking alone or in combination with noble metal oxide dehydrogenation, will further determine the product distribution between olefins and paraffins.

BRIEF DESCRIPTION OF THE DRAWING

The process of the present invention will be better understood when considered with the following drawings, wherein.

DETAILED DESCRIPTION OF THE INVENTION

Figure 1:
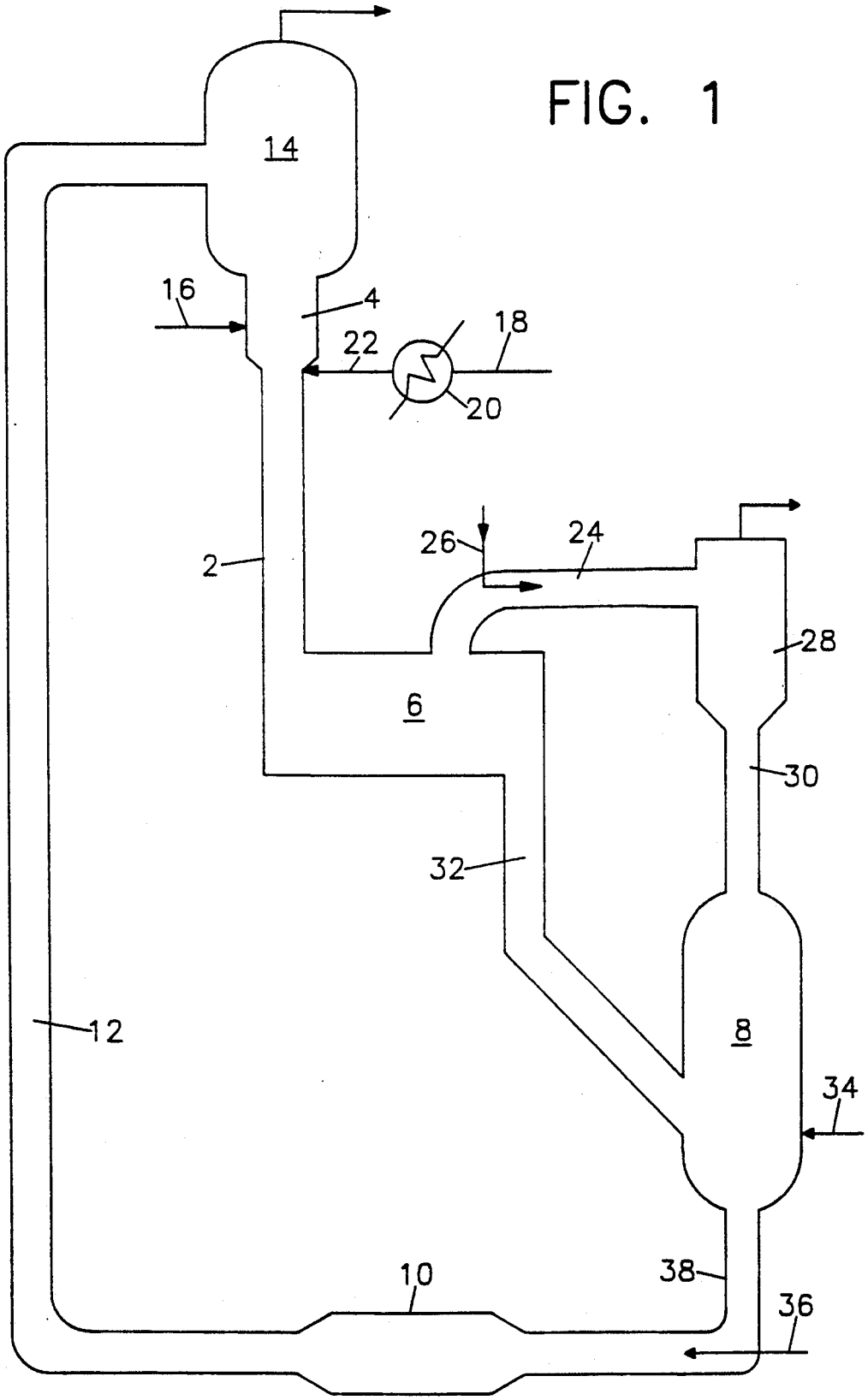
FIG. 1 is a schematic view of the process scheme of the present invention.

As has been previously indicated, the process of the present invention is directed to a means for cracking hydrocarbon feedstocks in the presence of catalytically active heat carrying solids for the purpose of producing olefins with a high selectivity especially towards $C_3$ to $C_5$ olefins and/or aromatics.

The hydrocarbons contemplated as feedstocks include the high boiling distillate gas oils, atmospheric gas oils, naphthas, and $C_4$–$C_7$ paraffins. However, it should be noted that the process has general applications for catalytically cracking a wide range of hydrocarbons to produce the desired olefins and/or aromatics.

Referring to the drawings and first to FIG. 1, the process of the present invention can be performed in a short residence time fluidized solids cracking system 1, hereinafter QC system, incorporating a tubular reactor 2, a reactor feeder 4, a separator 6, a quench means 24 and a solids stripper 8.

The system 1 also includes means for regenerating the catalyst solids separated from the cracked product after the reaction. The system shown illustratively includes an entrained bed heater 10 wherein the catalyst solids can be regenerated and reheated, a transport line 12 and a fluid bed vessel 14 wherein the solids are stripped of combustion gases and again distributed to the reactor 2.

Figure 5:
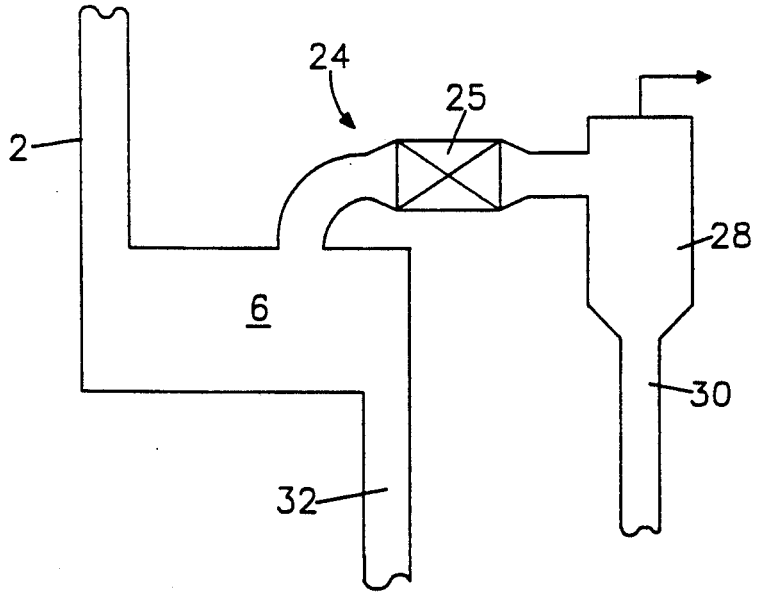
FIG. 5 is a schematic view of an optional quenching process scheme of the present invention.

In operation, hot catalyst solids from the fluid bed vessel 14 enter the reactor feeder 4 and are admixed with steam entering through a line 16. The hydrocarbon feed is delivered through a line 18 to a preheater 20, then through a line 22 to the upper region of the tubular reactor 2. The preheated hydrocarbon feed along with the catalyst solids and steam from the reactor feeder 4 are passed through the tubular reactor 2. Intimate mixing of the hot catalyst solids, steam and preheated hydrocarbon occurs in the reactor and cracking proceeds immediately. Upon exiting the tubular reactor 2 the cracked hydrocarbon effluent and steam are immediately separated from the catalyst solids in the separator 6 and the cracked effluent product passes overhead through the quench area 24 where the cracked product is immediately quenched with steam or a light hydrocarbon delivered to the quench area 24 through a quench line 26. This reduces the temperature of the mixture below the point where substantial thermal reactions occur. Alternatively, the cracked product exiting the tubular reactor 2 and separated from the catalyst solids in the separator 6 may be quenched by passing the entire mixture over a bed of solids with catalytic (dehydrogenation) activity. Since dehydrogenation is an endothermic reaction, the flowing mixture will be cooled as the reaction proceeds This can be used with the introduction of steam to improve the reaction conditions. As seen in FIG. 5, the preferred method of quenching in this manner includes the use of a catalyst reactor 25, in which the bed of the catalytic solids are contained, located immediately downstream of the separator 6, where quenching occurs in the previous embodiment.

The quenched product is passed through a cyclone 28 where small amounts of entrained catalyst solids are removed and delivered through a line 30 to the solids stripper 8 where they are combined with the bulk of the stripped solids delivered from the separator 6 through a line 32. In the solids stripper 8, the catalyst solids are striped of residual hydrocarbon by steam, nitrogen or other inert gases delivered to the solids stripper 8 through a line 34.

The catalyst solids, which have accumulated carbon or coke deposits from the tubular reactor 2 are then passed to the entrained bed heater 10. Air delivered to the heater 10 through a line 36 is mixed with the stripped catalyst solids in the heater 10 and the mixture is fed into the transport line 12 for conveying the catalyst solids back to the fluid bed vessel 14. In the presence of air from the line 36, the carbon deposits on the catalyst solids are removed by combustion to provide the heat necessary for the cracking reaction. If additional fuel is required it may be added into the entrained heater 10 from a fuel source (not shown).

In essence, the process of the present invention is conducted by delivering a hydrocarbon such as naphtha, atmospheric gas oil or mixtures thereof, through the line 18 to the preheater 20 wherein the temperature of the hydrocarbon is elevated to about 800°–900° F. Simultaneously, catalyst solids from the fluid bed vessel 14 are delivered to the reactor feeder 4 (best seen in FIG. 2) where they are admixed with steam supplied through the line 16 and delivered to the reactor at a temperature in the range of 1000–1600° F. The catalyst solids to the hydrocarbon feed ratio ranges from 1 to 60:1 based on weight depending on the particular catalyst utilized. The water vapor/hydrocarbon feed ratio is in the range of 0 to 1.0, preferably 0.0 to 0.3.

Optionally, the catalytic cracking process may be initiated by injecting an alkane such as ethane into the tubular reactor 2, via injection line 16, to form olefins and free radicals. This will tend to increase isomerization by forming carbonium ions and stabilize the heavier hydrocarbon formation by competing with the free radicals formed as well. Such alkanes are added just upstream of the hydrocarbon feed 22.

A suitable catalyst solids for the present invention may be one of the generally available supports having acid properties such as, silica gel, alumina, clays, etc. The catalyst solid can have associated therewith other catalytically active material. Alternatively, the catalyst system employed may be a conventional zeolitic FCC catalyst or one of the high activity ZSM-5 or rare earth zeolitic catalysts. The catalyst employed may also include a dehydrogenation catalyst consisting of one of the noble metal oxides such as the oxides of iron, chromium, platinum, etc. on a suitable support such as silica alumina. Alternately, the catalyst could be a mixture of the aforementioned catalysts to achieve specific yield distributions.

The composite hydrocarbon feedstock is elevated to 800° to 1100° F. and the catalyst solids are heated to 1200° to 1700° F. in the tubular reactor 2. The ratio of solids to hydrocarbon is set by heat balance and desired solids catalytic activity.

The cracked effluent product and catalyst solid effluent from the tubular reactor 2 flow directly into separator 6 (best seen in FIG. 3) where a separation into a gas product phase and a catalyst solid phase is effected. The gas product is removed via the line 24, while the catalyst solids enter the solids stripper 8 through the line 32. An in-line quench of the gas product is provided in quench area 24 through the quench line 26. Cold solids, water, steam, light hydrocarbons, and recycle oils are examples of suitable quench materials. Alternatively, quenching takes place in the catalyst reactor 25 (see FIG. 5) by passing the product over a catalyst bed, the additional reaction being without the presence of solids.

The total residence time from the point of hydrocarbon introduction to the tubular reactor 2 to the point of quench in the quench area 24, optionally comprising a catalyst reactor 25, is preferably about 0.1 to 0.3 seconds.

In the solids stripper 8 the catalyst solids are stripped of gas impurities by a stream of steam, nitrogen or inert gas delivered through the line 34. Vapors are removed from the solids stripper 8 through the line 30.

The stripped catalyst solids are removed from the stripper 8 through a line 38. The catalyst solids which have accumulated carbon from the tubular reactor 2 are passed to the entrained bed heater 10 where air is delivered through a line 36 to provide the necessary atmosphere for regenerating the catalyst solids. The catalyst solids are entrained in the heater 10 and returned to the fluid bed vessel 14 through the transport line 12 where the catalyst solids continue to regenerate. In addition, the regeneration of the catalyst solids raises the temperature of the catalyst solids to about 1200° to 1700° F. prior to delivery of the catalyst to the fluid bed vessel 14.

Figure 2:
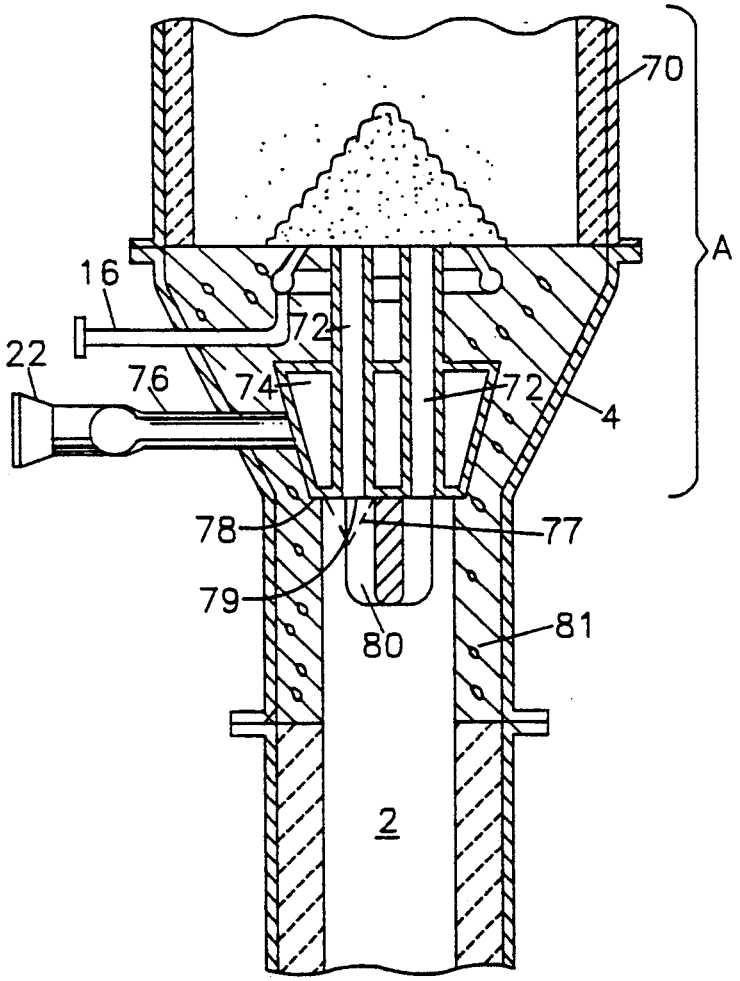
FIG. 2 is a cross-sectional elevational view of the reactor feeder employed in the apparatus of the present invention.

Details of the reactor feeder 4 are more fully described in U.S. Pat. No. 4,338,187 to Gartside et al., which is incorporated herein by reference. The reactor feeder of Gartside et al. has the capability of rapidly admixing hydrocarbon feed and catalyst solids. As seen in FIG. 2, the reactor feeder 4 delivers catalyst solids from a solids receptacle or fluid bed vessel 70 through vertically disposed conduits 72 to the tubular reactor 2 and simultaneously delivers hydrocarbon feed to the tubular reactor 2 at an angle into the path of the catalyst solids being discharged from the conduits 72. An annular chamber 74 to which hydrocarbon is fed by a single entry comprising a toroidal feed line 76 terminates in angled openings 78. A mixing baffle or plug 80 also assists in effecting rapid and intimate mixing of the hydrocarbon feed and the catalyst solids. The edges 79 of the angled openings 78 are preferably convergently beveled, as are the edges 79 at the reactor end of the conduits 72. In this way, the gaseous hydrocarbon stream from the chamber 74 is angularly injected into the mixing zone and intercepts the catalyst solids phase flowing from the conduits 72. A projection of the gas would form a cone shown by dotted lines 77, the vortex of which is beneath the flow path of the solids. By introducing the gaseous hydrocarbon phase angularly, the two phases are mixed rapidly and uniformly, and form a homogeneous reaction phase.

The mixing of a solid phase with a gaseous phase is a function of the shear surface between the solids and gas phases, and the flow area. A ratio of shear surface to flow area (S/A) of infinity defines perfect mixing while poorest mixing occurs when the solids are introduced at the wall of the reaction zone. In the system of the present invention, the gas stream is introduced annularly to the solids which ensures high shear surface. By also adding the gas phase transversely through an annular feed means, as in the preferred embodiment, penetration of the phases is obtained and even faster mixing results. By using a plurality of annular gas feed points and a plurality of solid feed conduits, even greater mixing is more rapidly promoted, since the shear surface to flow area ratio for a constant solids flow area is increased. Mixing is also a known function of the length to diameter ratio of the mixing zone. A plug creates an effectively reduced diameter D in a constant length L, thus increasing mixing.

The plug 80 reduces the flow area and forms discrete mixing zones. The combination of annular gas addition around each solids feed point and a confined discrete mixing zone greatly enhances the conditions for mixing. Using this preferred embodiment, the time required to obtain an essentially homogenous reaction phase in the reaction zone is quite short. Thus, this preferred method of gas and solids addition can be used in reaction systems having a residence time below 1 second, and even below 100 milliseconds. Because of the environment of the tubular reactor 2 and the reactor feeder 4, the walls are lined with an inner core 81 of ceramic material.

Figure 3:
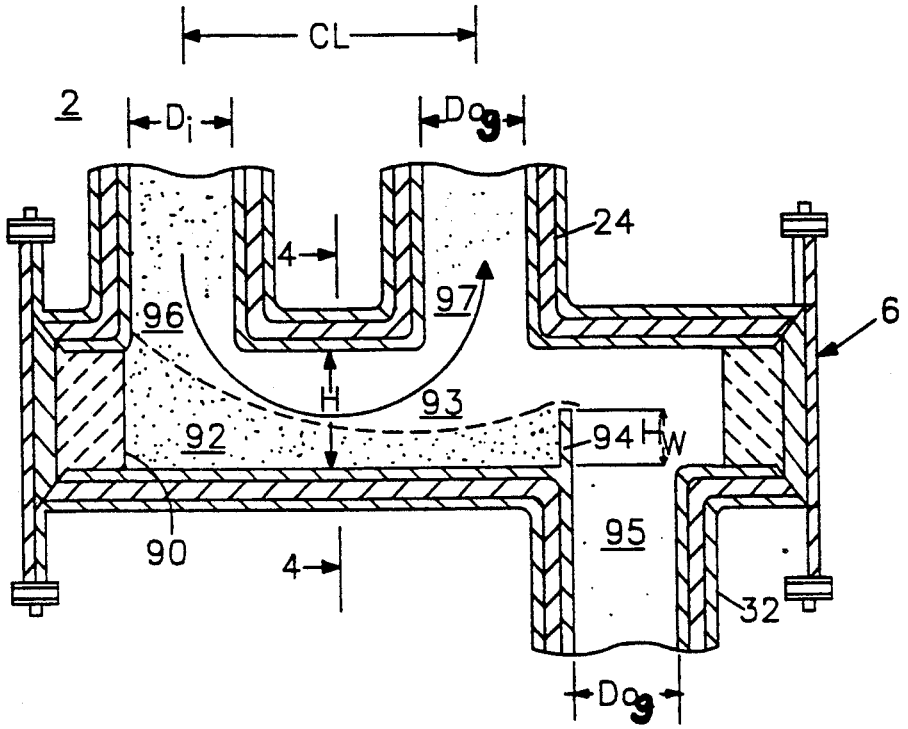
FIG. 3 is a cross-sectional elevational view of the separator employed in the present invention.

The separator 6 of the QC system, as shown in FIG. 3, can also be relied on for rapid and discrete separation of product and catalyst solids discharging from the tubular reactor 2. The inlet to the separator 6 is directly above a right angle corner 90 at which a mass of catalyst solids 92 collect within a chamber 93. An optional weir 94 downstream from the right angle corner 90 facilitates accumulation of the mass of solids 92 especially when run on small scale rather than commercial scale production. The gas outlet 24 of the separator 6 is oriented 180° from a separator gas-solids inlet 96 and the solids outlet line 32 is directly opposed in orientation to the gas outlet 24 and downstream of both the gas outlet line 24 and the weir 94.

In operation, centrifugal force propels the catalyst solids to the wall opposite inlet 96 of the chamber 93 while the gas portion having less momentum, flows through the vapor space of the chamber 93. Initially, catalyst solids impinge on the wall opposite the inlet 96 but subsequently accumulate to form a static bed of solids 92 which ultimately form in a surface configuration having a curvilinear arc of approximately 90° of a circle. Solids impinging upon the bed 92 are moved along the curvilinear arc to the solids outlet 95, which is preferably oriented for downflow of solids by gravity. The exact shape of the arc is determined by the geometry of the particular separator and the inlet stream parameters such as velocity, mass flowrate, bulk density, and particle size. Because the force imparted to the incoming solids is directed against the static bed 92 rather than the separator 6 itself, erosion is minimal. Separator efficiency, defined as the removal of solids from the gas phase leaving through the outlet 97, is therefore, not affected adversely by high inlet velocities, up to 150 ft./sec., and the separator 6 is operable over a wide range of dilute phase densitites, preferably between 0.1 and 10.0 lbs./ft.$^3$. The separator 6 of the present invention achieves efficiencies of about 90%, although the preferred embodiment, can obtain over 97% removal of catalyst solids.

It has been found that for a given height H of the chamber 93, efficiency increases as the 180° U-bend distance between the inlet 96 and the outlet 97 is brought progresively closer to the inlet 96. Thus, for a given height H the efficiency of the separator 6 increases as the flow path decreases and, hence, residence time decreases. Assuming an inside diameter $D_i$ of the outlet 96, the distance CL between the centerlines of the inlet 96 and the outlet 97 is preferably not greater than 4.0 ($D_i$), while the most preferred distance between said centerlines is between 1.5 and 2.5 ($D_i$) Below 1.5 ($D_i$) better separation is obtained but difficulty in fabrication makes this embodiment less attractive in most instances. Should this latter embodiment be desired, the separator 6 may require a unitary casting design because the inlet 96 and the outlet 97 would be too close to one another to allow welded fabrication.

It has been found that the height H should be at least equal to the value of $1.5 \times D_i$ or 4 inches in height, whichever is greater. Practice teaches that if H is less than $D_i$ or 4 inches the incoming stream is apt to disturb the bed solids 92 thereby reentraining solids in the gas product leaving through the outlet 97. Preferably the height H is on the order of twice $D_i$ to obtain even greater separation efficiency. While not otherwise limited, it is apparent that too large a height H eventually merely increases residence time without substantive increases in efficiency. The width W shown in FIG. 4 of the flow path is preferably between 0.75 and 1.25 times $D_i$, most preferably between 0.9 and 1.10 ($D_i$).

The outlet 97 may be of any inside diameter (Dog). However, velocities greater than 75 ft./sec. can cause erosion because of residual solids entrained in the gas. The inside diameter Dog of the outlet 97 should be sized so that a pressure differential between the solids stripper 8 shown in FIG. 1 and the separator 6 exists such that a static height of solids is formed in the solids outlet line 32. The static height of solids in the solids outlet line 32 forms a positive seal which prevents gases from entering the solids stripper 8. The magnitude of the pressure differential between the solids stripper 8 and the separator 6 is determined by the force required to move the solids in bulk flow to the solids outlet 95 as well as the height of solids in the line 32. As the differential increases the net flow of gas to the solids stripper 8 decreases. Solids, having gravitational momentum, overcome the differential, while gas preferentially leaves through the gas outlet 97. Preferably, the inside diameter Dog of the gas outlet 97 is the same as the inside diameter of the inlet 96, when one outlet is employed, to provide outlet velocity less than or equal to inlet velocity.

Figure 4:
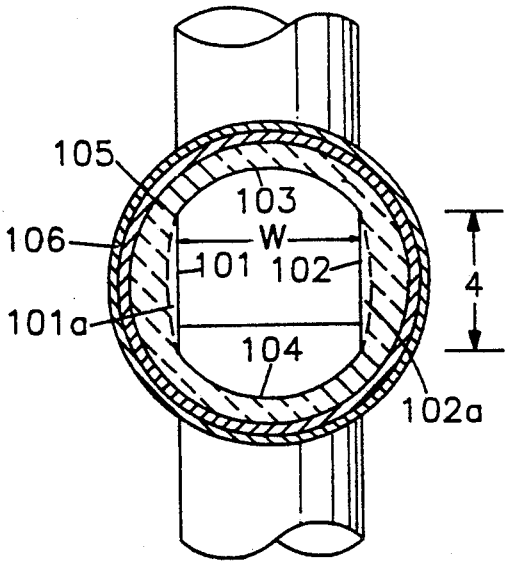
FIG. 4 is a sectional view through line 4—4 of FIG. 3.

FIG. 4 shows a cutaway view of the separator 6 along section 4—4 of FIG. 3. It is essential that longitudinal side walls 101 and 102 be rectilinear, or slightly arcuate as indicated by the dotted lines 101*a* and 102*a*. Thus, the flow path through the separator 6 is essentially rectangular in cross-section having a height H and width W as shown in FIG. 4. The embodiment shown in FIG. 4 defines the geometry of the flow path by adjustment of the lining width for the walls 101 and 102. Alternatively, baffles, inserts, weirs or other means may be used. In like fashion the configuration of the walls 103 and 104 transverse to the flow path may be similarly shared, although this is not essential.

The separator shell and manways are preferably lined with erosion resistant linings 105, which may be required if solids at high velocities are encountered. Typical commercially available materials for erosion resistant linings include Carborundum Precast Carbofrax D, Carborundum Precast Alfrax 201 or their equivalent. A thermal insulation lining 106 may be placed between the shell and the lining 105 and between the manways and their respective erosion resistant linings when the separator 6 is to be used in high temperatures service.

The details of the separator 6 are more fully described in U.S. Pat. No. 4,288,235 which is incorporated herein by reference.

An alternative embodiment of the apparatus employed to carry out the present invention is disclosed in the aforementioned Gartside et al. Ser. No. 084,328, incorporated herein by reference.

Referring to the drawings and particularly to FIGS. 6–9, there is described a system 202 comprising a reactor system 204, a solids regeneration assembly 208 and a solids delivery system 210.

Figure 7:
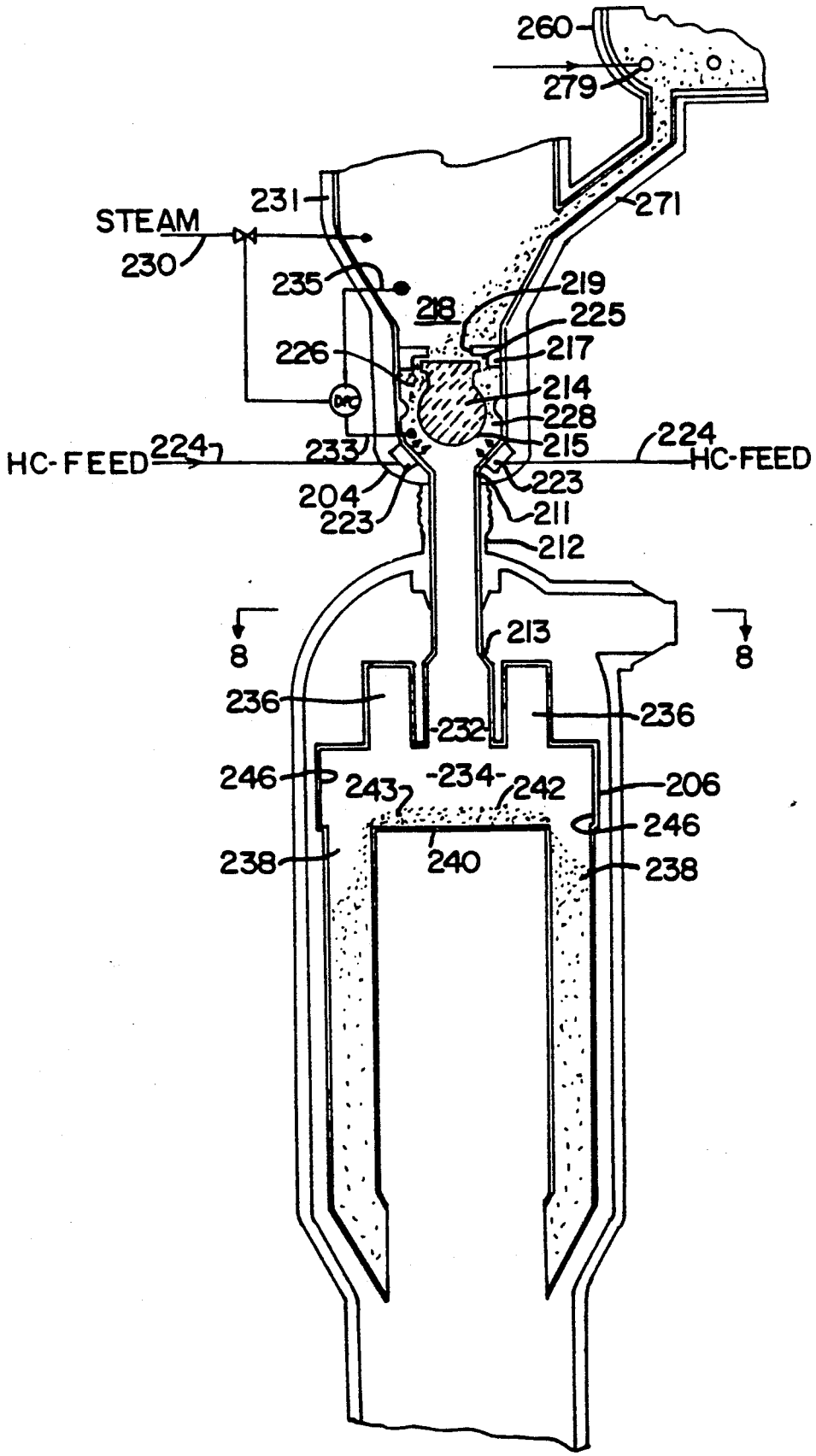
FIG. 7 is a cross-sectional elevational view of one embodiment of the reactor and gas-solids separator employed in the present invention.
Figure 8:
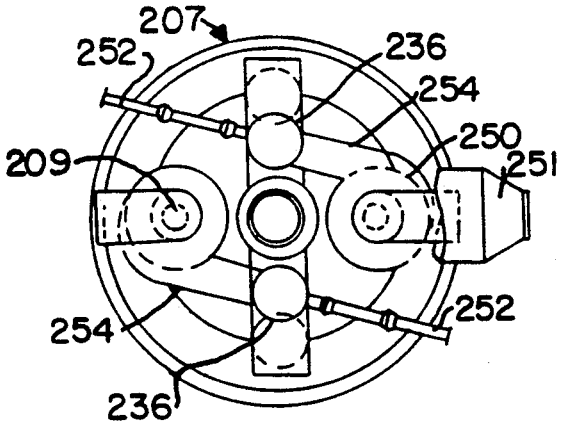
FIG. 8 is a sectional plan view through line 8—8 of FIG. 7.

The reactor system 204, best seen in FIG. 7, includes a convergent mixing section 211, an elongated reaction section 212, a divergent section 213 downstream of the elongated reaction section 212, a separator 206 and a quench system 207 (shown in FIG. 8). The mixing sections 211 are formed with a plug section 214 shown in cross-section as having an arcuate lower surface 215. A horizontally disposed plate 217 is arranged over the plug section 214 in spaced-relationship with the plug section 214 to form solids inlet passages 219 to the interior of the mixing section 211. The solids inlet passages 219 are configured in cross-section with a right angle turn and terminate in a reactangular openings 225 through which the particulate solids enter the mixing section 211, in the form a curtain of solids 226. The horizontal openings 225 are directly above each hydrocarbon feed inlet. Venturi configured passages 203 extend from the solids inlet passages 219 to the hydrocabon feed inlets 228.

Steam plenums (not shown) are arranged along each longitudinal edge of the horizontal opening 225 to deliver pre-acceleration gas (steam) through nozzles (not shown) into the curtain of solids 226 passing through the horizontal openings 225. A gas delivery line (not shown) is provided to deliver gas, usually steam or light hydrocarbon, under pressure to the nozzles. The nozzles are arranged at a downward angle of 45° to the horizontal. The pre-acceleration gas is delivered to the plenums at pressures of 3 to 5 psi above the pressure in the reactor and discharges through the nozzles at the same relative pressure at a velocity of about 150 feet per second. The pre-acceleration gas accelerates the flow of solids through the horizontal openings 225 from a nominal three to six feet per second to approximately 50 feet per second for the mix of solids and pre-acceleration gas. A more detailed description is found at Gartside et al Ser. No. 084,328.

The hydrocarbon feed inlets 228 are located on the reactor wall arranged either normal to the solids curtain 226 or at an angle upwardly of 30° into the solids curtain 226. The hydrocarbon feed is delivered to a manifold 223 through a line 224. The feed inlet nozzles 228 are fed with hydrocarbon from the manifold 223. As seen in FIG. 7, the feed inlet nozzles 228 are diametrically opposed from each other in the same horizontal plane. The mixing zone 211 of the reactor is rectangular with the configuration making a transition to a tubular reactor at the elongated reaction section 212.

The feedstock entering the mixing zone 211 through nozzles 228 immediately impinge the solids curtains 226 and the desired mixing of feed and hot particulate solids occurs. With the opposing set of nozzles 228, the opposing feed jets and entrained solids from the solids curtain 226 will be directed by the arcuate contour 215 of the plug section 214 and impact with each other at approximately the vertical centerline of the mixing zone 211. When a gas-liquid mixed phase hydrocarbon is fed through the nozzles 228, the nozzles 228 are arranged at an angle normal or 90° to the solids curtain 226. When the hydrocarbon feed is a gas, the nozzles 228 are arranged at an upwardly directed angle of 30° into the solids curtain. The quantity of solids entering the mixing zone 211 of the reactor system 204 through the horizontal inlets 219 is controlled in large part by the pressure differential between the mixing zone 211 of the reactor system 204 and the chamber 231*a* above the solids reservoir 218 in a solids control hopper 231 directly above the horizontal inlets 219. Pressure probes 233 and 235 are located respectively in the mixing zone 211 of the reactor system 204 and the control hopper chamber 231*a* to measure the pressure differential. Gas (steam) under pressure is delivered through a line 230 to the control hopper chamber 231*a* to regulate the pressure differential between the mixing zone 211 of the reactor system 204 and the control hopper chamber 231*a* to promote or interrupt flow of the solids from the solids control hopper 231 to the mixing zone 211.

As best seen in FIG. 7, the separator 206 is comprised of a mixed phase inlet 232, a horizontal chamber section 234, a plurality of cracked gas outlets 236 and particulate solids outlets 238. The basic principles relating to relative diameters (Di, Dog, Dos), chamber height (H) and length (L) recited in the first embodiment described herein are applicable herein. The separator 206 is arranged in combination with the elongated cracking zone 212 and divergent section 213 of the reactor system 204. The divergent section 213 terminates in the separator mixed phase inlet 232 which is centrally disposed at the top of the horizontal section 234. As a result of the configuration of the composite reaction system including the separator 206, a solids bed 242 develops on the floor 240 of the horizontal section 234 with the cross-sectional profile 243 of the bed 242 forming a curvilinear arc over which the mixed phase gas and solids travel. The expansion of solids and cracked gas in the divergent section 213 enhances heat transfer and limits the velocity of the solids-gas mixture entering the separator 206.

The solids are sent to the lateral ends 246 of the horizontal section 234 and discharge downwardly through the solids outlets 238. The cracked gases follow a 180° path and after separation from the solids discharge through gas outlets 236 that are located on the top of the horizontal section 234 intermediate the lateral ends 246. The plurality of solids outlets 238 and gas outlets 236 provide simultaneously for both minimum time in the separation zone and maximum solids-gas separation.

The separation or quench system 207 also includes a conventional cyclone separator 250 directly downstream of each gas outlet 236, as best seen in FIG. 8. The entry line 254 to each cyclone separator 250 is arranged at an angle of 90° to the gas outlet 236 with the cyclone separator 250 vertically disposed in the system. The cyclone separators 250 serve to collect the remaining entrained particulate solids from the cracked gas discharged from the separator 206. A dipleg line 249, returns the particulate solids to the regeneration assembly 208 and the cracked gas is sent for downstream processing through the gas outlet 251.

Each cyclone entry line 254 extending from the cracked gas outlet 236 to the cyclone 250 is provided with a direct quench line 252. Quench oil, usually the 100°–400° F. cut from a downstream distillation tower is introduced into the cyclone 250 through the direct quench line 252 to terminate the reactions of the cracked gas.

Figure 9:
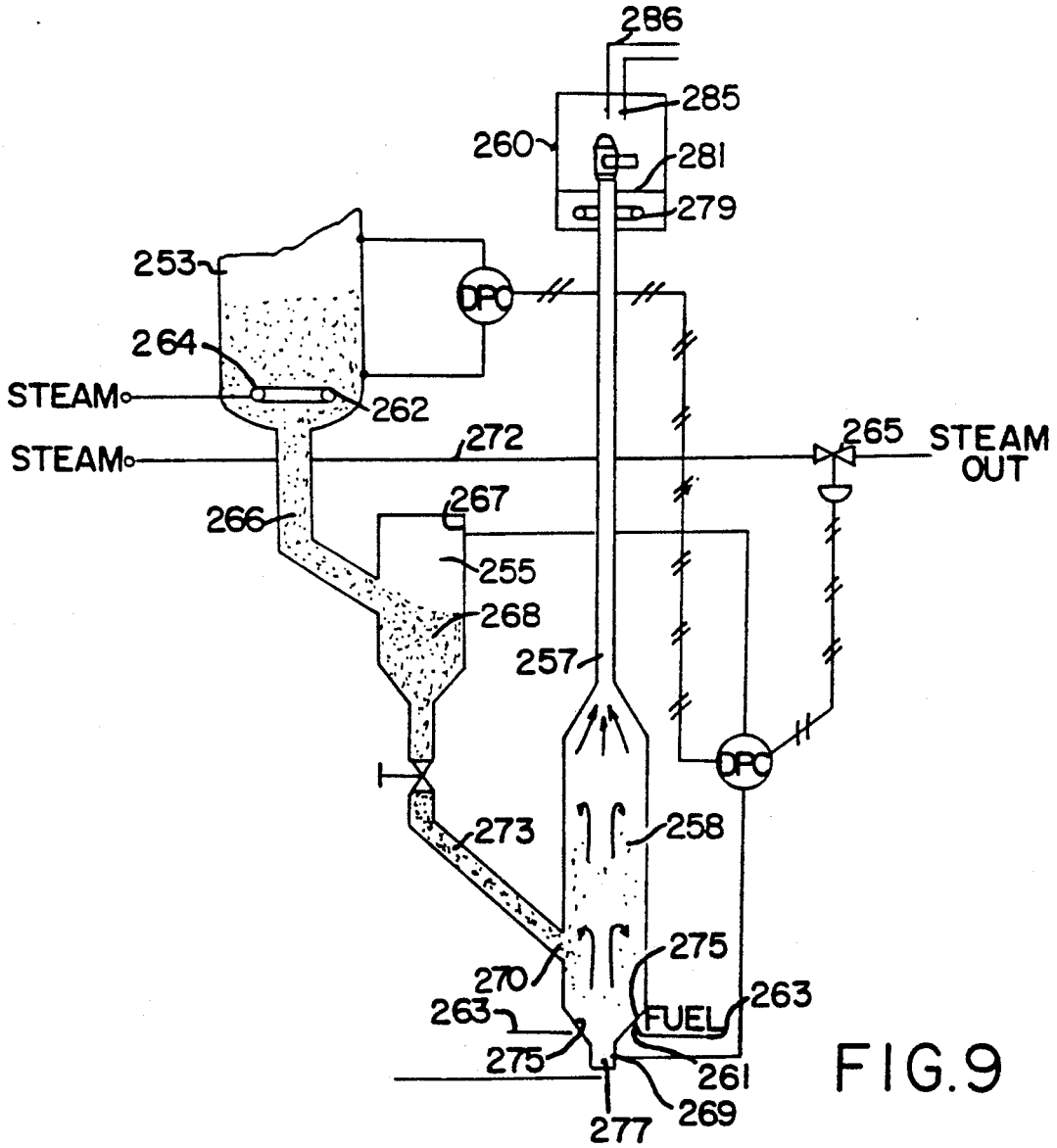
FIG. 9 is a schematic elevational view of another embodiment of the solids regeneration assembly employed in the present invention.

As best seen in FIG. 9, the regeneration assembly 208 is comprised of a stripper 253, control hopper 255, entrained bed heater 258, a lift line 257, and a rengerated solids vessel 260.

The stripper 253 is a tubular vessel into which the particulate solids from the separator 206 are delivered through solids outlet legs extending from the separator solids outlets 238 and from the cyclone diplegs 249. A ring 262 having nozzle openings 264 is provided at the bottom of the stripper 253. A stripping gas, typically steam is delivered to the ring 262 for discharge through the nozzles 264. The stripping steam passes upwardly through the bed of particulate solids to remove impurities from the surface of the particulate solids. The stripping steam and entrained impurities pass upwardly through the particulate solids in the stripper 253 and discharge through a vent line (not shown) to the cracked gas line.

The stripped solids are accumulated in the control hopper 255 for eventual delivery to the entrained bed heater 258. The control hopper 255 is a collection vessel in which solids enter through a standpipe 266 and from which an outlet line 273 extends to deliver solids to the entrained bed heater 258. The assembly of the control hopper 255 and the standpipe 266 provides for a slumped bed solids transport system. The pressure differential maintained between the slumped bed surface 268 in the control hopper 255 and the exit 270 of the outlet line 273 determine the solids flow rate between the control hopper 255 and the entrained bed heater 258. A line 272 is provided to selectively introduce steam under pressure into the control hopper 255 to regulate the pressure differential. Probes 267 and 269 are placed respectively in the control hopper 255 and entrained bed heater 258 to monitor the pressure differential and regulate a valve 265 in the steam line 272.

Figure 6:
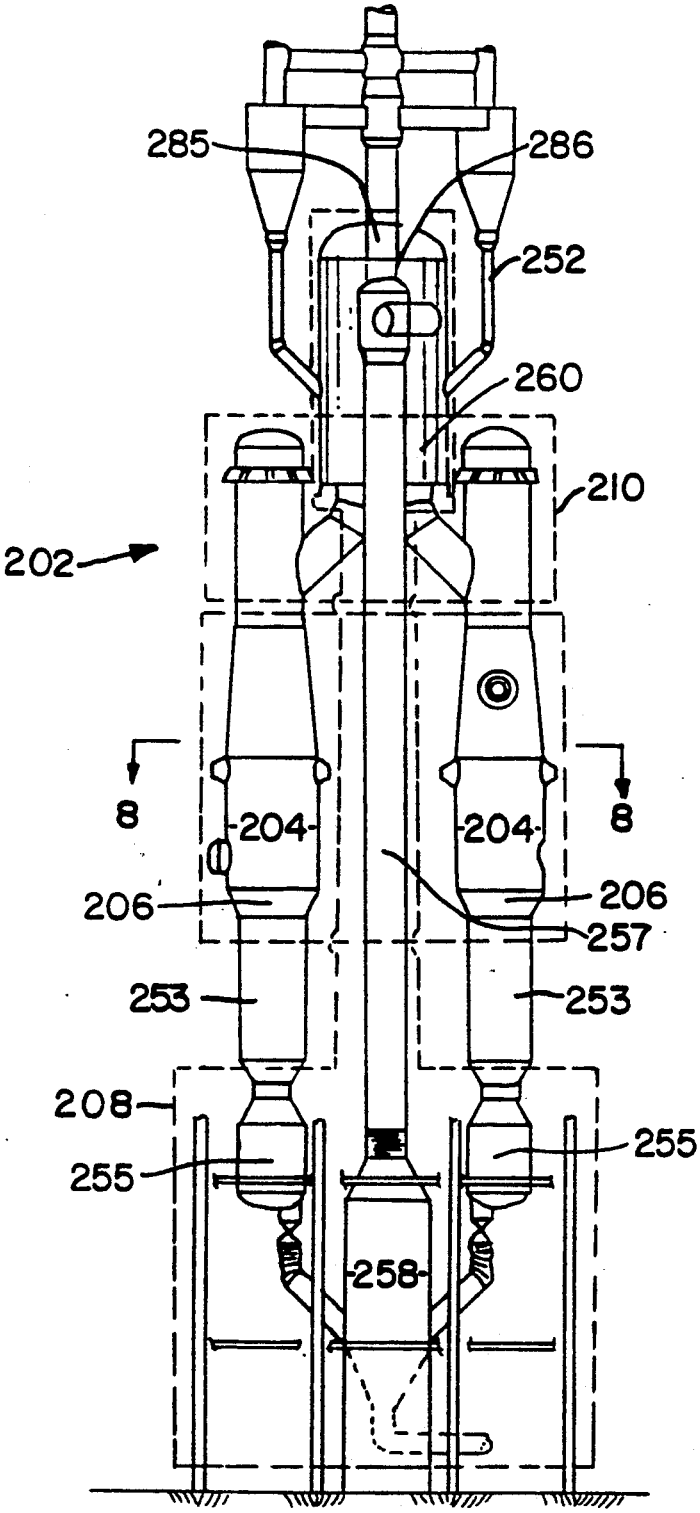
FIG. 6 is an elevational view of one embodiment of the overall system of the present invention.

The entrained bed heater 258 is essentially tubular in configuration. An array of distinct fuel nozzles 261 fed by fuel lines 263 are arranged essentially symmetrically on the lower inclined surface 275 of the entrained bed heater 258. Pressurized air enters the entrained bed heater 258 through a nozzle 277 arranged to direct the air axially upwardly through the entrained bed heater 258. The air jet provides both the motive force to lift the solids particles upwardly through the entrained bed heater 258 to the rengerated solids vessel 260 and the air necessary for combustion. The fuel is ignited by contact with the solids in the presence of air. The combustion gas/solids mixture moving upwardly through lift line 257 enters the regenerated solids vessel 260 tangentially, preferably, perpendicular to the lift line to separate the combustion gases from the solids. As shown in FIG. 6, the vessel 260 has a distube 285 in the gas outlet nozzle 286 to provide cyclonic movement which improves the separation efficiency of the system.

The regenerated solids vessel 260 is a cylindrical vessel provided with a standpipe 271, seen in FIG. 7, extending to the reactor hopper 231. Again the structure of the regenerated solids vessel 260 provides for accumulation of a slumped bed 281, seen in FIG. 9 above which pressure can be regulated to enable controlled delivery of the regenerated particulate solids to the reactor hopper 231.

The upper solids collection vessel 260 seen in FIGS. 6, 7 and 9 contains a stripping section as the lower portion with a stripping ring 279 and form a part of the solids deliver system 210. Above ring 279, the solids are fluidized; below the ring 279 the solids slump and are fed to the standpipe 271 shown in FIG. 7. The standpipe 271 feeds the slumped bed in the control hopper 231 as best seen in FIG. 7. Solids flow into the reactor hopper 231 through the standpipe 271 to replace solids that have flowed into the reactor 204. Unaerated solids (slumped solids) will not continue to flow into the reactor hopper 231 once the entrance 282 to the hopper 231 has been covered. Thus, the position of the entrance 282 defines the solids level in hopper 231. As solids flow from hopper 231 via the pressure differential between the vapor space in the chamber 231*a* above the bed 218 and the mixing zone 211, the entrance 282 is uncovered allowing additional solids to flow into the hopper 231.

One embodiment of the process of the present invention as shown in the accompanying FIG. 1 is illustrated by the following comparative example (Table I) wherein a light FCC naphtha is cracked employing conventional tubular pyrolysis, conventional catalytic cracking at typical FCC residence times of greater than 1 second using moderately active catalysts, catalytic cracking with high activity catalysts at short residence times for FCC units (0.9 seconds), and very short residence time cracking plus quench (QC system) with a similar high activity catalyst. Two cases employing the high activity catalyst are shown to illustrate the effect of residence time on olefin yields.

TABLE I

| Example: | Conventional Coil Pyrolysis A | Cat Cracker Conventional Catalyst B | Catalytic Cracker High Activity Catalyst C | QC with High Activity Catalyst D |
|---|---|---|---|---|
| Feedstock: | | Light FCC Naphtha | | |
| Residence time (sec): | | | | |
| Reactor | 0.3 | 1.0 | | |
| Total (to quench) | 0.3 | 2.0* | 0.9* | 0.15 |
| Reactor Temperature | 816 | 565 | 510 | 540 |
| Conversion, Wt % | 65 | 28 | 50 | 56 |
| Product Yield, Wt % | | | | |
| $CH_4$ | 13.4 | | 3.0 | 0.8 |
| Total C2's | 15.2 | 2.6 | 13.0 | 11.2 |
| $C_3H_6$ | 11.4 | 5.6 | 10.2 | 19.2 |
| $C_3H_8$ | 0.6 | 4.1 | 11.6 | 8.8 |
| Total $C_4$'s | 10.4 | 13.4 | 7.7 | 14.4 |
| $C_3H_8/C_3H_6$ ratio** | 0.05 | 0.73 | 1.14 | 0.46 |

*no quench
**paraffin/olefin ratio

Referring to Table I, Example A illustrates the yields obtainable using conventional pyrolysis operated at typical thermal cracking temperatures and residence times. Example B illustrates a conventional catalytic riser reactor employing typically longer residence times and lower temperatures than the pyrolysis Example A. As seen, the conventional catalytic conversions are substantially lower than those obtained in the pyrolysis Example A. The lower conversion is a result of the lower temperature operation (565° C. vs. 816° C.) with insufficient catalytic activity for this relatively light feedstock. Even at these low conversions however, the total $C_3$ and $C_4$ compounds are high relative to the pyrolysis case as a result of the carbonium ion mechanism. Further, the ratio of $C_3$ paraffins to $C_3$ olefins is substantially increased due to hydrogen transfer activity of the acidic cracking catalyst.

Example C illustrates the product yields which will be obtained by employing high activity acidic catalysts at low FCC residence times or high QC residence times without quenching. The selected operating conditions of Example C will result in a suppression of the methane and ethylene yields compared to the pyrolysis system of Example A. The conversion is increased relative to Example B even at lower temperatures (510° C. vs. 565° C.) due to the increased activity. There is a significant increase in the total $C_3$ production as a result of the acidic cracking cataylst (21.8 vs. 12.0) but the $C_4$ yields decrease due to the increased conversion. Further, due to the longer residence times, there is a significant amount of hydrogen transfer as evidenced by the unacceptably high $C_3$ paraffin to olefin ratio compared to either Example A or B.

Example D illustrates the dramatic improvement in olefin yields that will be obtained by employing the process of the present invention in a very short residence time QC system. As seen, there is about a 100% improvement in $C_3$ olefin yields when the reactor temperature is increased about 30° C. and the total kinetic residence time, i.e., cracking reaction plus separation plus quench, is reduced to about 0.15 seconds. In addition, the paraffins to olefin ratio is reduced to less than half that obtained in the longer residence time Example C. The paraffin to olefin ratio for this case is higher than for the pyrolysis case at a similar residence time as a result of the hydrogen transfer activity of the catalyst The methane yield, however, is further suppressed below the lower level of Example C and the $C_4$ yields are improved by almost 100% indicating less secondary cracking due to the quenching and short residence time reaction.

In another embodiment of the present invention, the QC system may be adapted to enhance the production of aromatics, and specifically benzene. Table II illustrates the use of the QC system to enhance aromatics production from the cracking of n-hexane at a fixed 70% conversion. Two examples of the QC system, one using a highly active catalyst, the other a deactivated zeolitic catalyst, are compared to conventional pyrolysis.

TABLE II

| | QC REACTOR | | |
|---|---|---|---|
| | Pyrolysis | High Activity | Deactivated |
| Example: | Reactor 1 | Catalyst 2 | Catalyst 3 |
| Temperature °C. | 735 | 550 | 740 |
| Total Residence Time (Sec) (including quench) | 0.2 | 0.2 | 0.2 |
| Conversion | 70 | 71 | 82 |
| Wt % Feed | | | |
| $CH_4$ | 6.3 | 7.0 | 9.8 |
| $C_2H_4$ | 35.0 | 8.4 | 35.2 |
| $C_3H_6$ | 19.8 | 27.1 | 4.6 |
| $C_3H_8$ | nil | 19.6 | 2.1 |
| Aromatics | nil | 2.1 | 20.9 |
| $C_3H_8/C_3H_6$ | nil | 0.72 | 0.46 |

Referring to Table II, Example 1, it is seen that a hydrocarbon feedstock conversion at 70% will be obtained in conventional pyrolysis at a reactor outlet temperature of 730° C. and a residence time of 0.2 second. As indicated, pyrolysis produces significant amounts of olefins but only trace amounts of paraffins and aromatics. Similar results are obtained when using a completely inert solid, such as pure alumina, in a QC cracking environment.

In the QC system using a high activity acidic cracking catalyst, 70% hydrocarbon conversion can be obtained at a reduced temperature of 550° C. and a residence time of 0.2 second (Example 2). Ethylene production will be suppressed while the yields of $C_3$ olefins and paraffins enhanced. Furthermore, only small amounts of aromatics are produced.

If instead of a highly active catalyst, a deactivated zeolitic catalyst is used, a completely different yield spectrum is obtained (Example 3). Zeolitic catalyst deactivation is usually a result of prolonged exposure to high temperatures and steam causing the zeolite matrix to collapse. This results in a significant reduction in catalyst surface area and hence catalyst activity. Typically in an FCC unit which uses zeolitic catalysts, the catalytic solids are withdrawn and fresh catalyst is added to maintain activity. Such "spent" solids are suitable for use as deactivated catalysts.

The reaction temperatures required are similar to those required to achieve pyrolysis conversion due to the low activity. However, quite unexpectedly, there is a substantial increase in aromatics production (specifically benzene) and a corresponding decrease in $C_3$ and $C_4$ olefin production. The ethylene yields are similar to those from pyrolysis given the predominance of the free radical cracking reactions at these temperatures. However, the deactivated catalyst provides enhanced aromatization activity at these higher temperatures and thus aromatics are formed at the expense of the $C_3$ and $C_4$ olefins and paraffins.

These unexpected results will thus enable an operator to vary the operating conditions of the QC system to either select high $C_3$ to $C_5$ olefin production or high aromatic production in accordance with the present invention, depending on the desired product, the available feedstocks and the choice of catalyst.

Specific embodiments of the invention have been described and shown in the above examples to illustrate the application of the inventive principles. The invention in its broader aspects is not limited to the specific described embodiments and departures may be made therefrom within the scope of the accompanying claims without departing from the principles of the invention and without sacrificing its chief advantages.

In another embodiment of the invention a dehydrogenation catalyst is combined with an acidic cracking catalyst.

TABLE III

| | MINAS NAPHTHA CRACKING | | |
|---|---|---|---|
| | Coil Pyrolysis | Moderate Activity Acidic Cracking Catalyst | Yield with Catalyst Yield from Coil Cracking |
| Residence Time (Sec) | 0.2 | 0.2 | |
| Temp C. | 827 | 746 | |
| Yield, wt % | | | |
| $CH_4$ | 12.5 | 9.5 | 0.76 |
| $C_2H_4$ | 23.0 | 17.3 | 0.75 |
| $C_2H_6$ | 3.7 | 2.8 | 0.76 |
| $C_3H_6$ | 13.4 | 13.7 | 1.20 |
| $C_3H_8$ | 0.5 | 3.0 | 1.20 |
| $C_4H_6$ | 4.2 | 0.7 | |
| $C_4H_8$ | 4.5 | 7.3 | 1.53 |
| $C_4H_{10}$ | 0.7 | 6.7 | |
| | 62.5 | 61.0 | |

The example shown in Table III uses a Minas naphtha feedstock and compares cracking both catalytically and thermally. The catalytic case requires a lower temperature to achieve the given conversion thus will have in this case only 75% of the thermal products ($C_1$ and $C_2$ compounds). The carbonium ion cracking will shift the yield spectrum to favor $C_3$ and $C_4$ compounds.

TABLE IV

| ISO/NORMAL $C_4$ YIELDS FROM MINAS NAPTHA CRACKING (REFERENCE TABLE III) | | | |
|---|---|---|---|
| | Coil Pyrolysis | Acidic Cat Only | Acidic Cat plus* Dehydrog Cat |
| I—$C_4H_8$ | 1.5 | 1.84 | 5.02 |
| N—$C_4H_8$ | 3.0 | 5.44 | 6.71 |
| I—$C_4H_{10}$ | 0.23 | 4.43 | 1.25 |
| N—$C_4H_{10}$ | 0.47 | 2.28 | 1.00 |
| Iso (% olefin) | 87 | 29 | 80 |
| Nor (% olefin) | 87 | 70 | 87 |

*Mixture of Sn and Cr oxides on an alumina support

As shown in Table IV, use of acidic catalyst alone results in a very significant increase in total iso $C_4$'s (paraffins plus olefins) due to the ionic nature of the cracking. However, most of the iso compounds appear as iso-paraffins whereas the thermodynamic equilibrium exclusively favors the production of olefins, not paraffins. In the case of the coil pyrolysis, both the iso and normal $C_4$'s are 87% olefinic indicating a reasonable approach to equilibrium. For the catalyst case however, the normal compounds are only 70% olefinic and the iso compounds only 29% olefinic This is because the hydrogen transfer activity of the catalyst results in a "new" equilibrium relationship based on reaction kinetics rather than thermodynamics. Iso compounds show a much greater tendency to undergo hydrogen transfer in the presence of the acidic catalyst than normal compounds.

When noble metal oxide catalysts are added to the flowing acidic cracking catalysts, the paraffins produced at the acidic sites can be dehydrogenated to their olefinic counterpart. The extent to which this occurs is dependent upon the concentration and activity of the dehydrogenation catalyst. In Table IV, a dehydrogenation catalyst consisting of oxides of tin (Sn) and chromium (Cr) is mixed with the acidic cracking catalyst to achieve an 80% approach to equilibrium for the iso compounds and a corresponding 87% approach for the normal compounds. As can be seen, the production of the valuable $C_4$ olefins, both normal and iso, are signficantly increased. The isobutylene production from the same feed is increased by a factor of over 3 and the normal butene by a factor of over 2. The use of mixed catalyst systems provides an additional product distribution flexibility for the catalytic process. Rather than admix the dehydrogenation catalyst with the acidic cracking catalyst and follow the mix reaction with a quench, using steam for example, the dehydrogenation catalyst can be located in a packed bed within a catalyst reactor 25 located downstream of the primary separation in separator 6. The paraffins formed by contact with the acidic catalyst will be dehydrogenated to their olefin counterpart.

What is claimed is:

1. A process for catalytically cracking a hydrocarbon feedstock selected from the group consisting of $C_4$ to $C_7$ paraffins, naphthas and light gas oils to selectively produce aromatics, ethylene or a combination thereof comprising:

(a) introducing the hydrocarbon feedstock to a cracking reactor;

(b) simultaneously delivering hot acidic cracking catalyst solids to the cracking reactor;

(c) catalytically and thermally cracking the hydrocarbon feedstock with heat supplied by the hot catalyst solids to form a cracked product;

(d) separating the cracked product from the hot catalyst solids; and (e) quenching the separated cracked product effluent over a bed of solids having catalyst dehydrogenation activity; wherein the total kinetic residence time of the hydrocarbon feedstock from step (a) through step (e) is in the range of from about 0.05 to 2.0 seconds.

2. The process of claim 1, wherein the residence time is from about 0.05 to 0.5 seconds.

3. The process of claim 1 further comprising:

(f) delivering the separated catalyst solids to a stripper to remove residual cracked gas products;

(g) combusting the separated catalyst solids to thereby remove carbon deposits and to heat the stripped catalyst solids to thereby form regenerated catalyst solids; and (h) transporting the regenerated catalyst solids to the cracking reactor.

4. The process of claim 1, wherein the hydrogenation catalyst is selected from noble metal oxides on an inert carrier.

5. The process of claim 1, wherein the temperature of the catalytic cracking reaction is from about 900° to 1500° F., and the weight ratio of catalyst solids to hydrocarbon feedstock is between 1 and 60.

6. The process of claim 5, wherein the temperature of the catalytic cracking reaction is from about 1000° F. to 1300° F., and the residence time is 0.1 to 0.3 seconds.

7. The process of claim 1, wherein the selectively produced aromatics comprise benzene.

8. The process of claim 1, wherein the catalyst solids are selected from the group consisting of silica gel, alumina and clay.

9. The process of claim 8, further comprising catalyst support in the catalyst wherein the catalyst support is selected from the group consisting of silica gel, silica-alumina, clays or a mixture of any of the foregoing.

10. The process of claim 9, wherein the cracked produce is primarily mono-aromatics and said catalyst solids are thermally deactivated.

11. The process of claim 1, comprising delivering the hydrocarbon feed stream and hot catalyst solids to a tubular thermal regenerative cracking reactor through a reactor feeder having vertical passages communicating with the tubular regenerative cracking reactor and the solids in a hot solids vessel, providing localized fluidization of the solids above the vertical passages, and delivering the hydrocarbon feed to the tubular thermal regenerative reactor at an angle to the path of the catalyst solids entering the thermal regenerative reactor.

12. The process of claim 1, comprising separating the hot catalyst solids and the cracked product gases in a separator wherein the catalyst solids and cracked product gases enter the separator through a separator inlet and reverse direction ninety degrees and then the product gases reverse direction another ninety degrees to effect a one hundred eighty degree reversal in direction from the entry direction and then the catalyst solids continue in the path oriented ninety degrees from the catalyst solids cracked product gas separator inlet and thereafter, the path of the catalyst solids is directed downwardly and the separated product gases are quenched.

13. The process of claim 1, comprising separating the catalyst solids and cracked gases in a separator comprising a chamber for rapidly disengaging about 80% of the catalyst solids from an incoming mixed phase stream, said chamber having approximately rectilinear longitudinal side walls to form a flow path of height H and width W approximately rectangular in cross section, said chamber also having a mixed phase inlet of inside width $D_i$; a gas outlet and solids outlet, said inlet being at one end of the chamber and disposed normal to the flow path of height H which is equal to at least $D_i$, or 4 inches, whichever is greater, and the width W is from 0.75 $D_i$ said solids outlet being at the opposite end of the chamber and being suitably arranged for downflow of discharged solids by gravity, and said gas outlet being between the mixed phase inlet and the solids outlet at a distance no greater than 4 $D_i$ from the inlet as measured between respective centerlines and oriented to effect a 180° change in direction of the gas whereby resultant centrifugal forces direct the catalyst solids in the incoming stream toward a wall of the chamber opposite to the inlet forming thereat and maintaining an essentially static bed of solids, the surface of the bed defining a curvilinear path of an arc of approximately 90° of a circle for the outflow of solids to the solids outlet.

14. A process as in claim 1 further comprising the step of injecting alkanes into the reactor upstream of the hydrocarbon feed.

* * * * *